US006788186B1

(12) United States Patent
Yu

(10) Patent No.: US 6,788,186 B1
(45) Date of Patent: Sep. 7, 2004

(54) ACTIVATION MECHANISM FOR SWITCH DEVICES

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/448,959

(22) Filed: May 31, 2003

(51) Int. Cl.[7] ..... H01H 37/52; H01H 37/70
(52) U.S. Cl. ..... 337/66; 337/56; 337/91
(58) Field of Search ..... 337/59, 66, 56, 337/76, 53, 67, 68, 69, 74, 75, 91, 85, 140, 112, 113; 200/553–557, 334, 529–535, 520–525

(56) References Cited

U.S. PATENT DOCUMENTS

| | | | | | |
|---|---|---|---|---|---|
| 4,167,720 | A | * | 9/1979 | Krasser | 337/60 |
| 4,937,548 | A | * | 6/1990 | Sdunek | 337/70 |
| 5,223,813 | A | * | 6/1993 | Cambreleng et al. | 337/66 |
| 5,451,729 | A | * | 9/1995 | Onderka et al. | 200/18 |
| 5,558,211 | A | * | 9/1996 | Heydner et al. | 200/553 |
| 5,786,742 | A | * | 7/1998 | Yin | 337/66 |
| 6,121,868 | A | * | 9/2000 | Chiang | 337/37 |
| 6,307,460 | B1 | * | 10/2001 | Yu | 337/37 |
| 6,377,158 | B1 | * | 4/2002 | Yu | 337/37 |
| 6,377,159 | B1 | * | 4/2002 | Yu | 337/37 |
| 6,417,756 | B1 | * | 7/2002 | Yu | 337/66 |
| 6,445,273 | B1 | * | 9/2002 | Yu | 337/37 |
| 6,456,185 | B1 | * | 9/2002 | Yu | 337/37 |
| 6,496,095 | B2 | * | 12/2002 | Yu | 337/66 |
| 6,512,441 | B1 | * | 1/2003 | Yu | 337/37 |
| 6,552,644 | B2 | * | 4/2003 | Yu | 337/66 |
| 6,674,033 | B1 | * | 1/2004 | Wang | 200/334 |

FOREIGN PATENT DOCUMENTS

| | | | | |
|---|---|---|---|---|
| DE | 2704008 A | * | 8/1977 | H01H/5/77 |
| FR | 2530072 A1 | * | 1/1984 | H01H/73/30 |

* cited by examiner

*Primary Examiner*—Anatoly Vortman

(57) ABSTRACT

A switch device includes a casing and a push member movably connected to a top of the casing. A path is defined in the casing and a guide pin is pivotably connected to the push member wherein the guide pin includes an insertion which is movably engaged with the path. A driving plate is pivotably connected to the casing and includes an aperture through which the insertion extends. A free end of a bimetallic plate is held by a hook portion of the driving plate. The bimetallic plate includes a contact point which contacts the other contact point on a terminal by pushing the push member and the insertion rotate the driving plate in the aperture. When the current is overload, the deformation of the bimetallic plate rotates the driving plate at the hook portion of the bimetallic plate. The aperture in the driving plate includes three recesses and the first recess and the third recess respectively receive the insertion when the switch device is in OFF and ON status. The second recess allows the driving plate to rotate without being interrupted by the guide pin.

7 Claims, 11 Drawing Sheets

(OFF)

(ON)

ACTIVATION MECHANISM FOR SWITCH DEVICES

FIELD OF THE INVENTION

The present invention relates to a switch device that includes an activation mechanism for directly activate a bimetallic plate of the switch device. The mechanism includes a driving plate having an aperture with three recesses so as to provide the guide pin a movement path during operation between ON and OFF status.

BACKGROUND OF THE INVENTION

A conventional switch device, especially for those switches using a bimetallic plate to prevent the switch device from being burnt out when an overload happens, is known, such as U.S. Pat. Nos. 4,167,720; 4,937,548; 5,223,813; 5,451,729; and 5,558,211. Nevertheless, the switches commonly involve a complicated structure and are composed of a great number of parts, which leads to high risk of malfunctioning. Besides, activation of the bimetallic plate is indirectly done by a toggle so that the metallic plate is activated for a period of time after the action on the toggle is completed. This very short period of time could result in bum out of the switch device in an overload of the current. FIGS. 1–3 of the attached drawings show the device disclosed in U.S. Pat. No. 5,223,813, and the switch member is connected to a link that is then connected to an arm. A bimetallic plate is compressed by the arm and is deformed when the arm is activated by the link and the switch member. The direct press on the metallic plate from the arm could break the metallic plate and the reaction of the metallic plate is slower than expected.

Therefore, it is desired to have an activation mechanism for switch devices wherein the metallic plate is not directed pressed by any part in the switch device so as to improve the shortcomings of the conventional switch devices.

SUMMARY OF THE INVENTION

In accordance with an aspect of the present invention, there is provided a casing having a path defined therein and a protrusion is surrounded by the path. Two first terminals extend from a bottom of the casing and one of which has a first contact point.

A push member is movably engaged on a top of the casing and two positioning springs are biased between the push member and the casing. A guide pin is pivotably connected to the push member and includes an insertion that is movably engaged with the path in the casing. A bimetallic plate has an end connected to the other terminal and includes a free section. A second contact point is connected to the free section and located above the first contact point.

A driving plate is rotatably connected to the casing and includes a polygonal aperture including a first recess, a second recess and a third recess. The insertion of the guide pin and the protrusion extend through the aperture. A hook portion extends from the driving plate and holds a free end of the bimetallic plate. The insertion is engaged with the first recess when the switch device is in OFF status. The insertion is engaged with the third recess when the switch device is in ON status. The second recess allows the guide pin in the aperture not to impede the rotation of the driving plate when overload.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
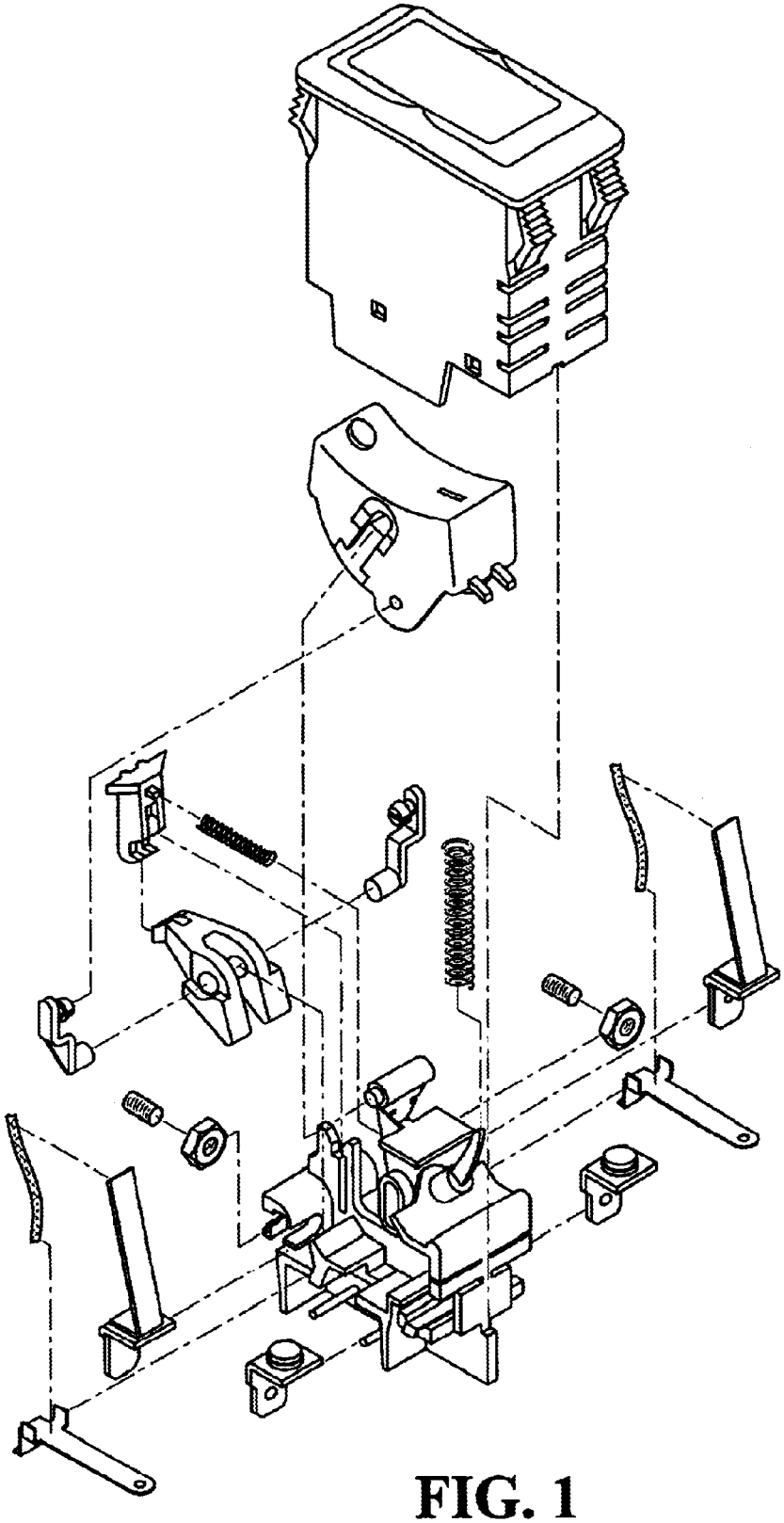
FIG. 1 (PRIOR ART)
FIG. 1 is an exploded view of a conventional switch device.
Figure 2:
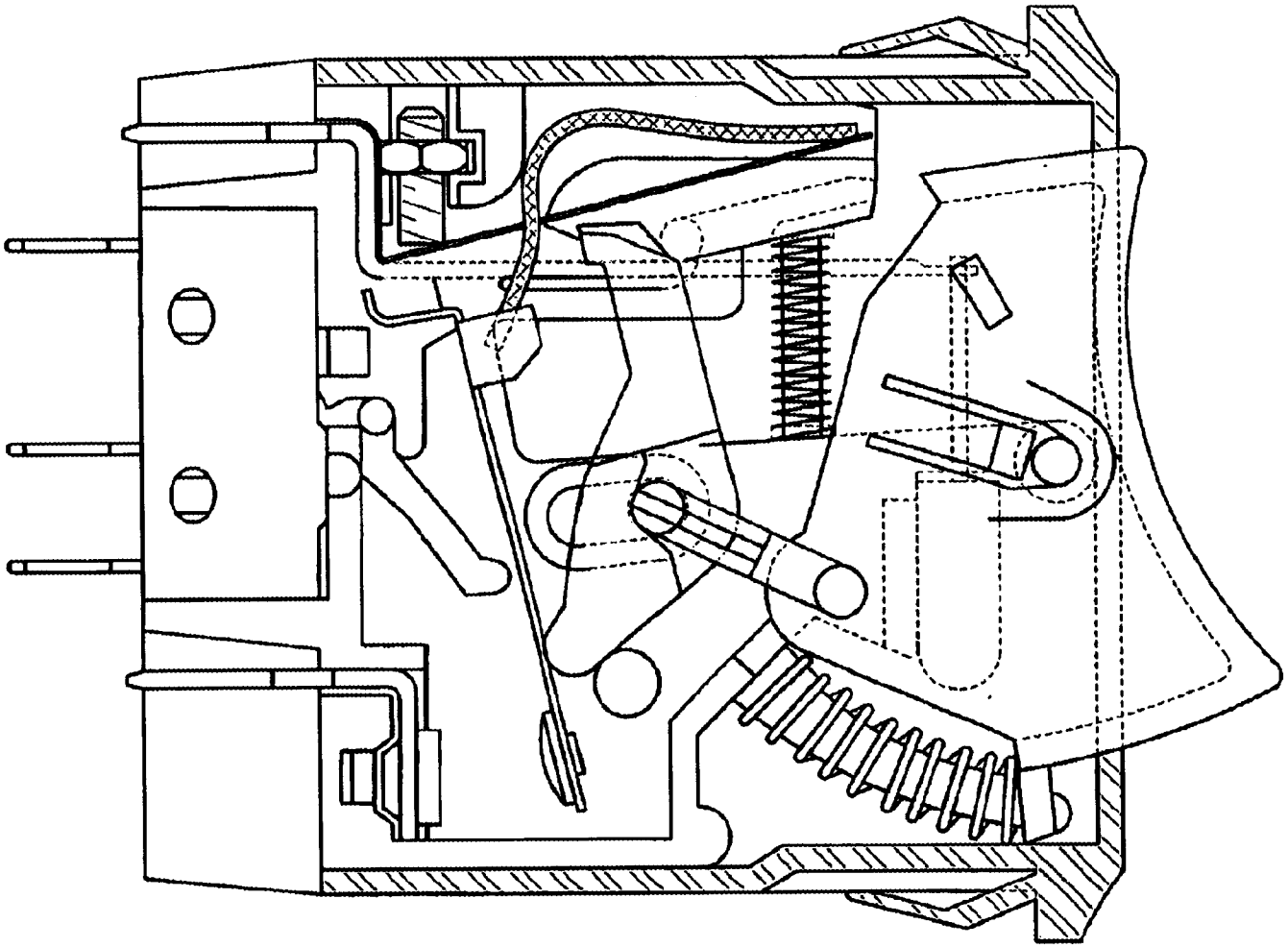
FIG. 2 (PRIOR ART)
FIG. 2 shows that the conventional switch device is in OFF status.
Figure 3:
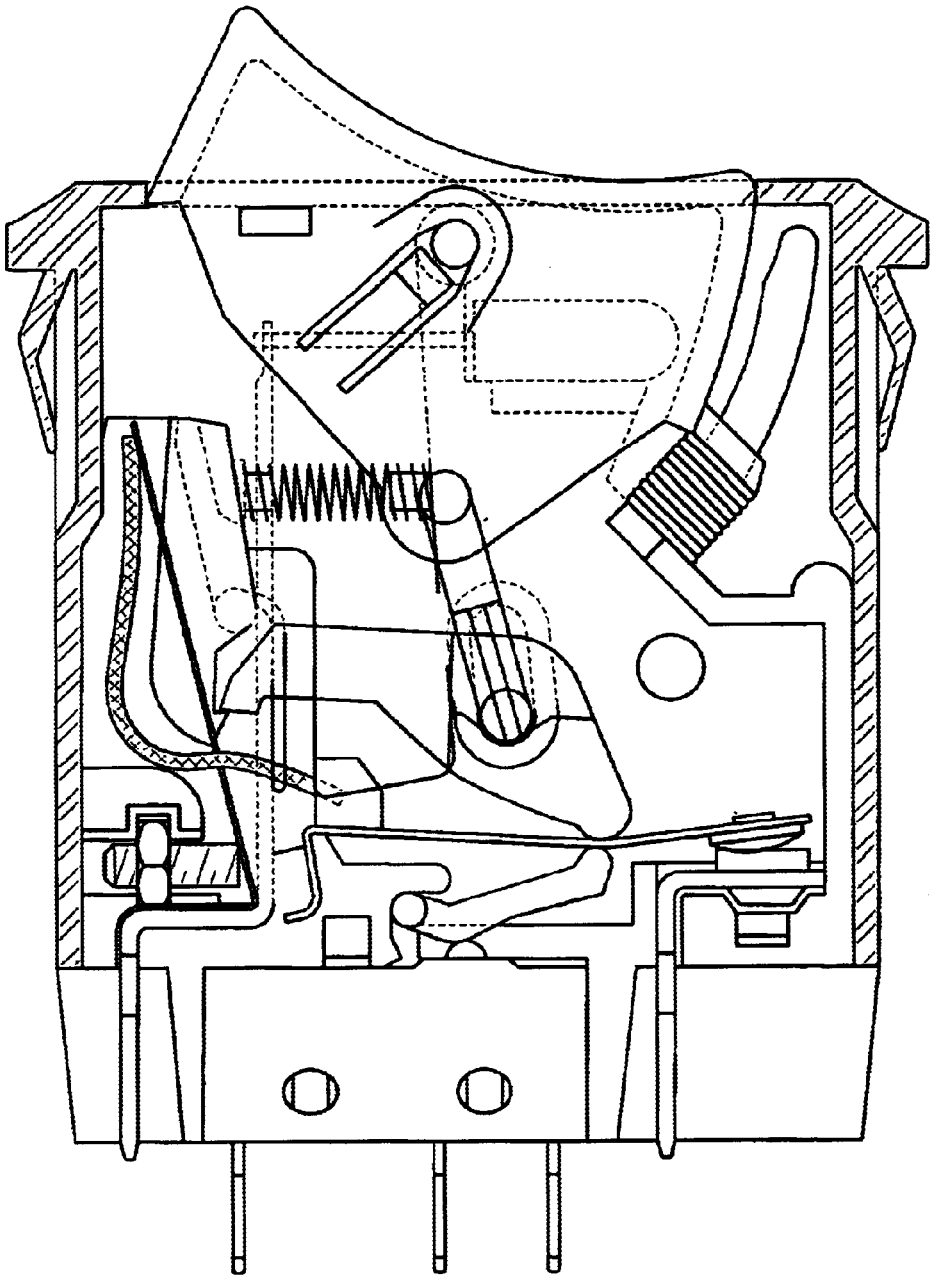
FIG. 3 (PRIOR ART)
FIG. 3 shows that the conventional switch device is in ON status.
Figure 4:
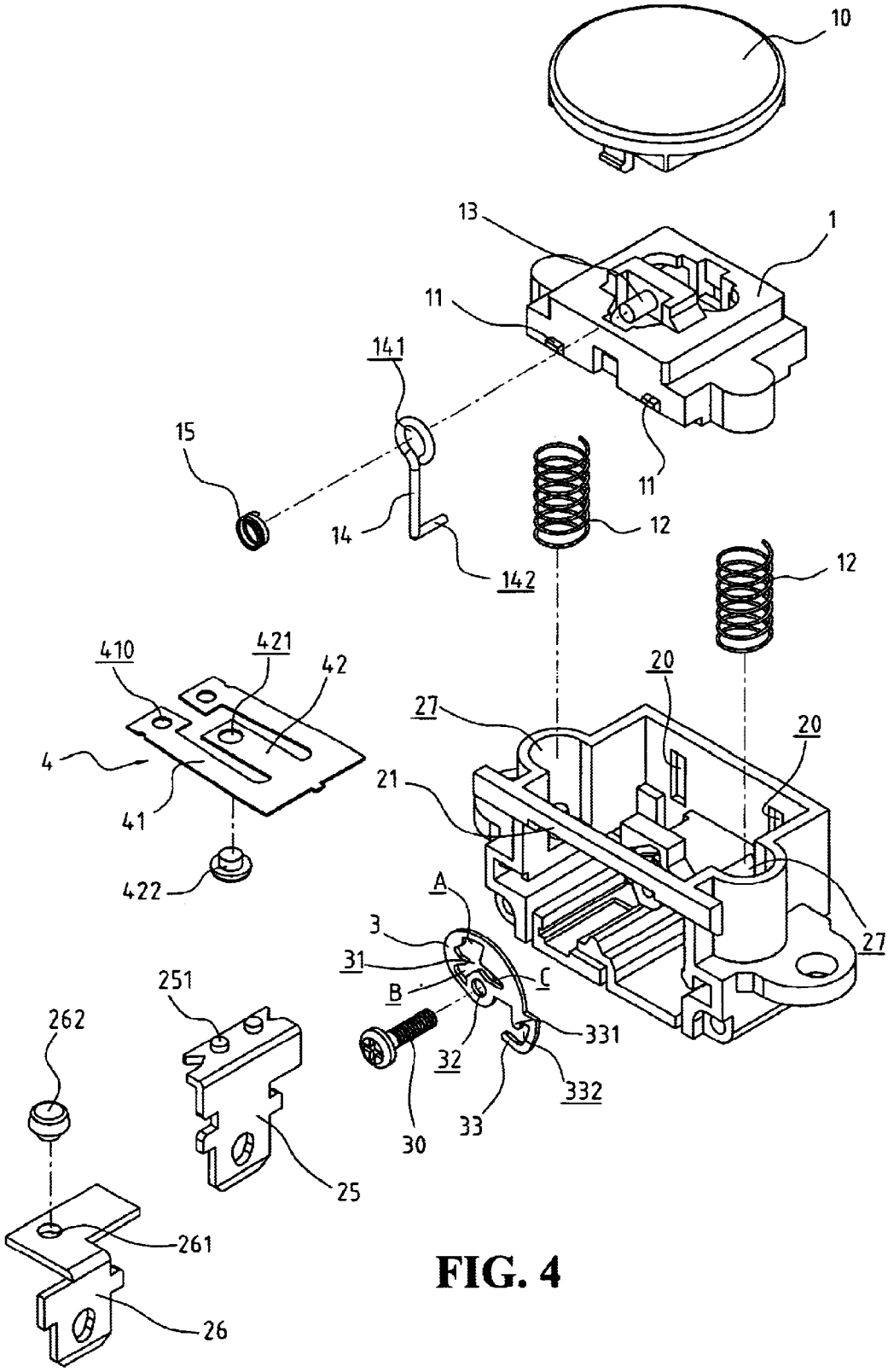
FIG. 4 is an exploded view of a switch device in accordance with the present invention.
Figure 5:
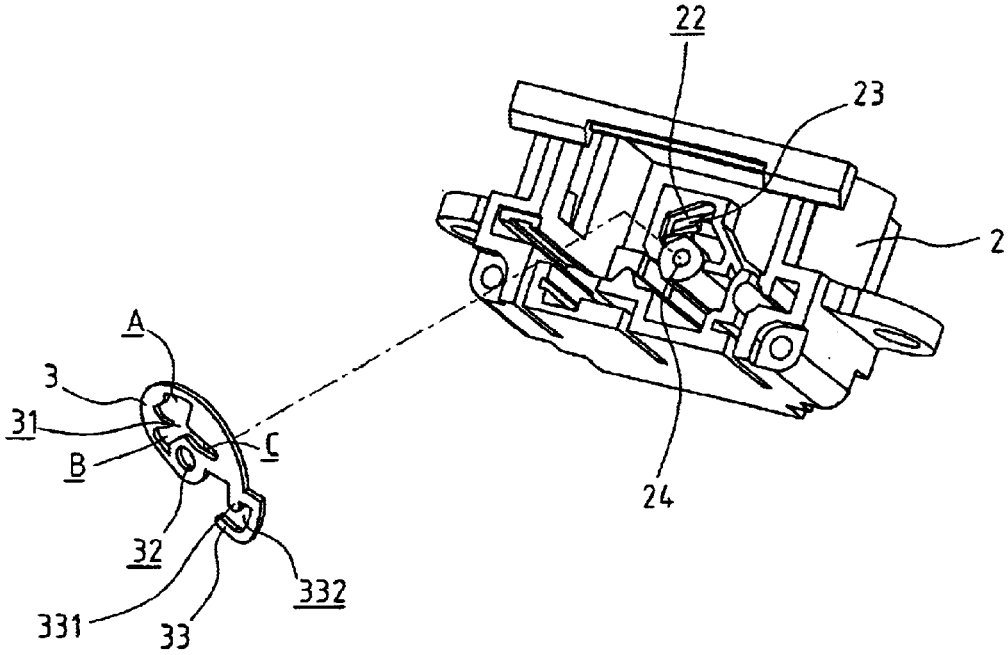
FIG. 5 shows a driving plate and a casing of the switch device of the present invention.
Figure 6:
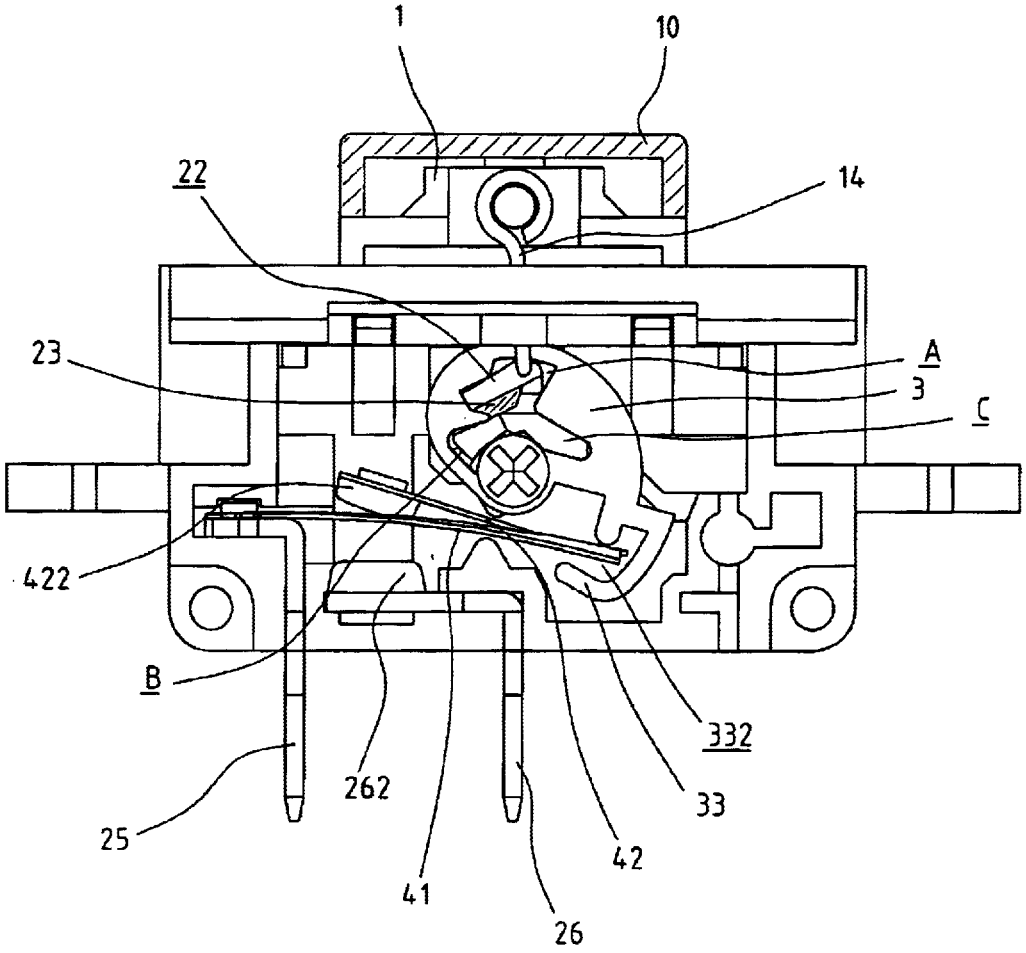
FIG. 6 shows that the switch device of the present invention is in OFF status.

Referring to FIGS. 4–6, a switch device of the present invention comprises a casing 2 having two recesses 27 defined in an inside of two opposite walls of the casing 2 so as to receive two positioning springs 12 therein. The other two sides of the rectangular casing 2 respectively has two engaging notches 20 defined in an inside thereof and a transverse bar 21 is connected between the two opposite walls of the casing 2. The transverse bar 21 has another two engaging notches. A frame is located in the casing 2 and includes a path 22 defined therein. A protrusion 23 is surrounded by the path 22.

A push member 1 is movably engaged on a top of the casing 2 and biased by the two springs 12. A decoration pad 10 is engaged with the push member 1. The push member 2 includes four ridges 11 extending from two opposite sides thereof so as to be engaged with the engaging notches 20 in the side wall and the bar 21 of the casing 2. The push member 2 can be pushed downward to compress the springs 12 which provide a force to push the push member 2 back to its original position.

A first terminal 25 and a second terminal 26 each have an end located in the casing 2 and the other end of each of the two terminals 25, 26 extends from a bottom of the casing 2. The first terminal 25 has two protrusions 251 on the end in the casing 2 so as to be engaged with holes 410 of two sides 41 of a bimetallic plate 4, wherein the distance between the two holes 410 is slightly longer than the distance between the two protrusions 251 so that the bimetallic plate 4 is slightly bent. The second terminals 26 has a first contact point 262 engaged with a hole 261 defined in the end thereof in the casing 2. The bimetallic plate 4 includes a free section 42 located between the two sides of the bimetallic plate 4 and a second contact point 422 is engaged with a hole 421 defined through the free section 42. The second contact point 422 is located above the first contact point 262.

A driving plate 3 is rotatably connected to the frame in the casing 2 by extending a bolt 30 through a hole 32 in the driving plate 3 and engaged with the frame. The driving plate 3 includes a polygonal aperture 31 through which the protrusion 23 extends. The aperture 31 includes a first recess A, a second recess B and a third recess C. A hook portion 33 extends from the driving plate 3 and a boss 331 extends from an inner periphery of the hook portion 33. The free end of the bimetallic plate 4 extends through a gap 332 between the boss 331 and the inner periphery of the hook portion 33.

Figure 7:
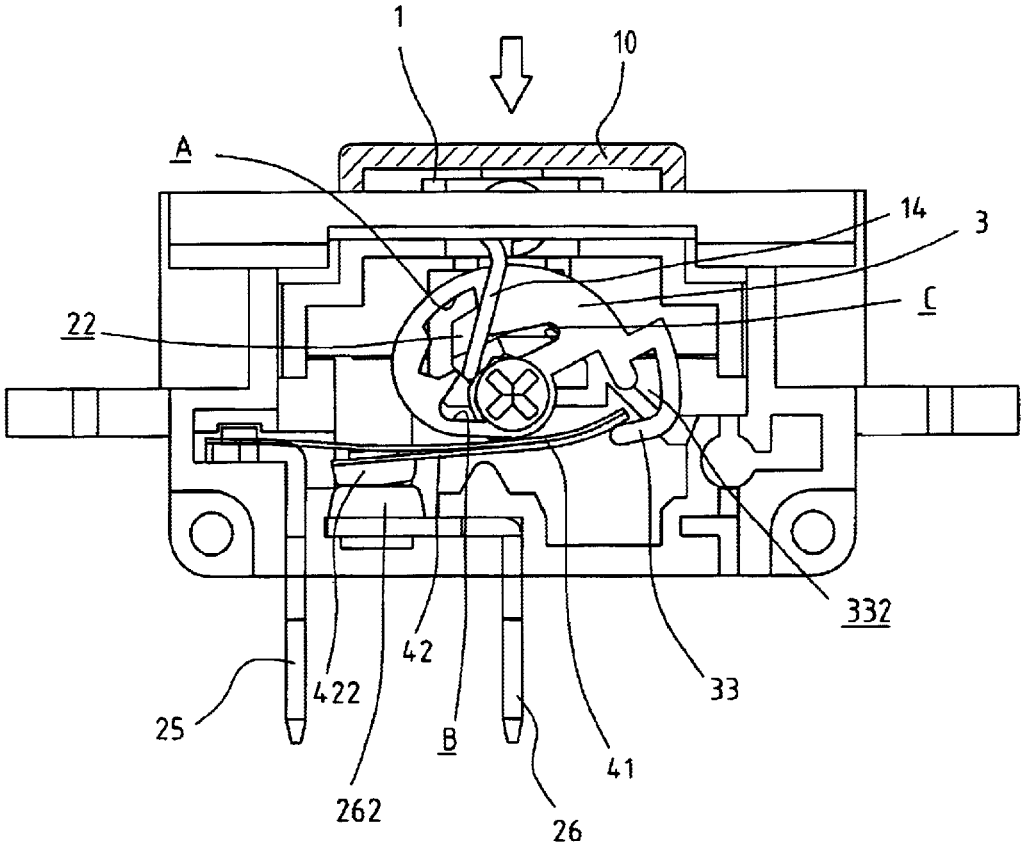
FIG. 7 shows that a push member is pushed and two contact points are in contact with each other.
Figure 8:
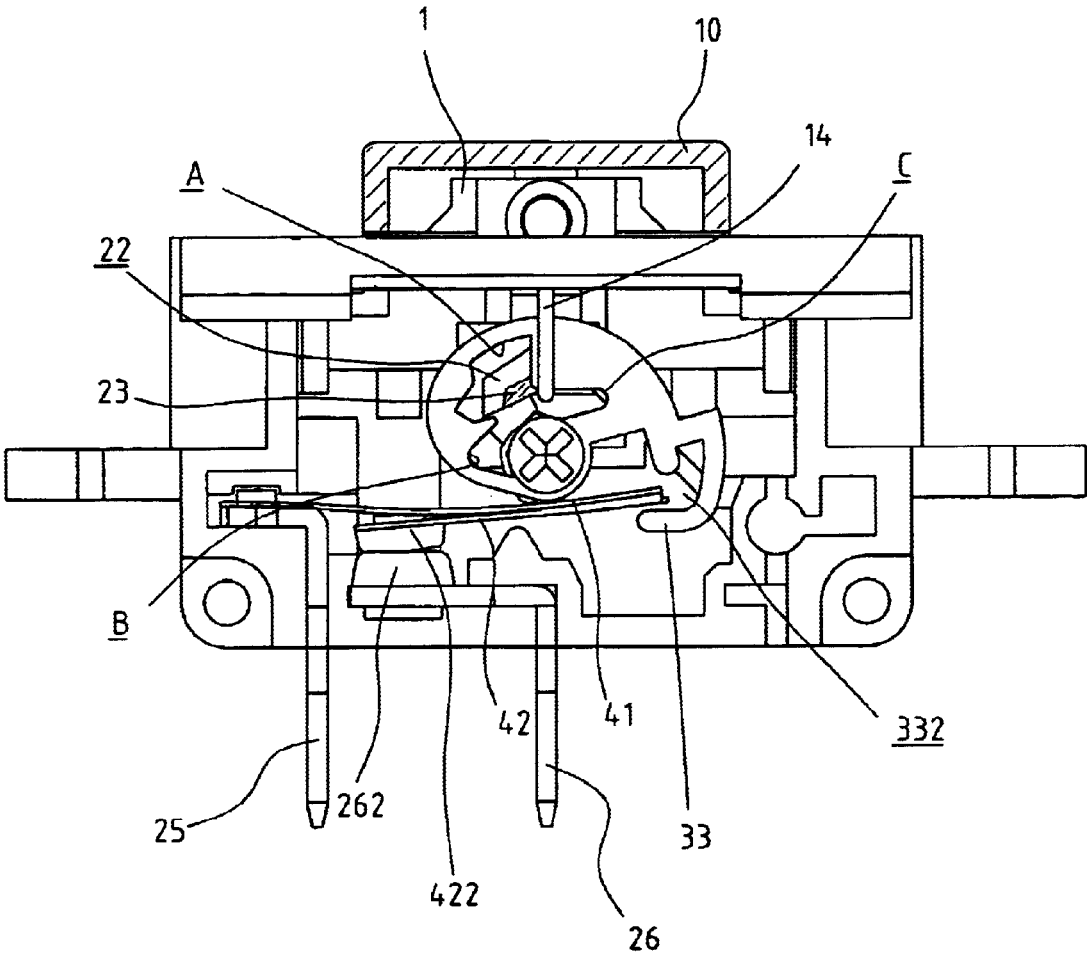
FIG. 8 shows that the switch device of the present invention is in ON status.

A guide pin 14 includes a ring 141 on one end and an insertion 142 on the other end of the guide pin 14. The ring 141 is mounted to a rod 13 extending from the push member 1 and a spring 15 is mounted to the bar 13 so as to press on the ring 141 to apply a force to the insertion 142 which extends through the aperture 31 in the driving plate 3 and is movably engaged with the path 22 in the casing 2. As shown in FIG. 6, the insertion 142 is engaged with the first recess A in a top of the periphery of the aperture 31 when the switch device is in OFF status. When pushing the push member 1 as shown in FIG. 7, the insertion 142 is moved downward along the path 22 and rotates the driving plate 3 counter clockwise by the movement of the insertion 142 so that the free end of the bimetallic plate 4 is bent to let the second contact point 422 contact the first contact point 262 to form the ON status. As shown in FIG. 8, when releasing the push member 1, the push member 1 is pushed upward by the positioning springs 12 and the insertion 142 is lifted with the push member 1 and moves upward and stopped by an inside of the third recess C. The inside stopping the insertion 142 is located horizontally.

Figure 9:
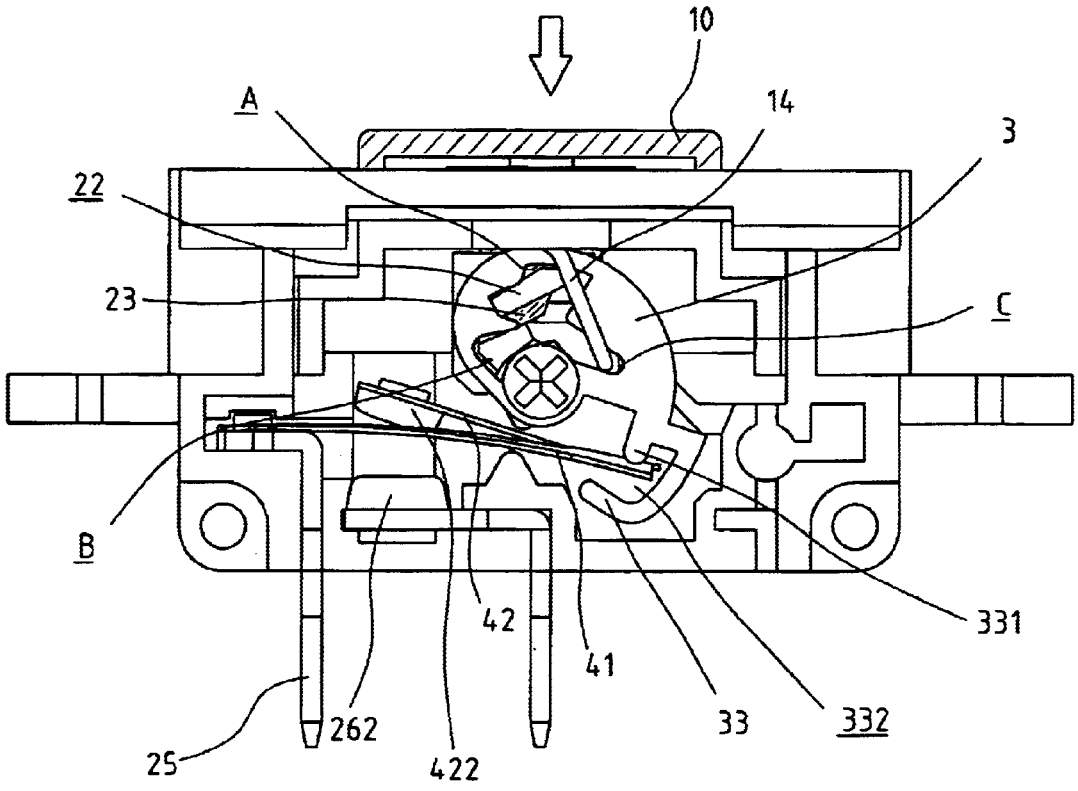
FIG. 9 shows that the push member is pushed again to set the switch device in OFF status.
Figure 10:
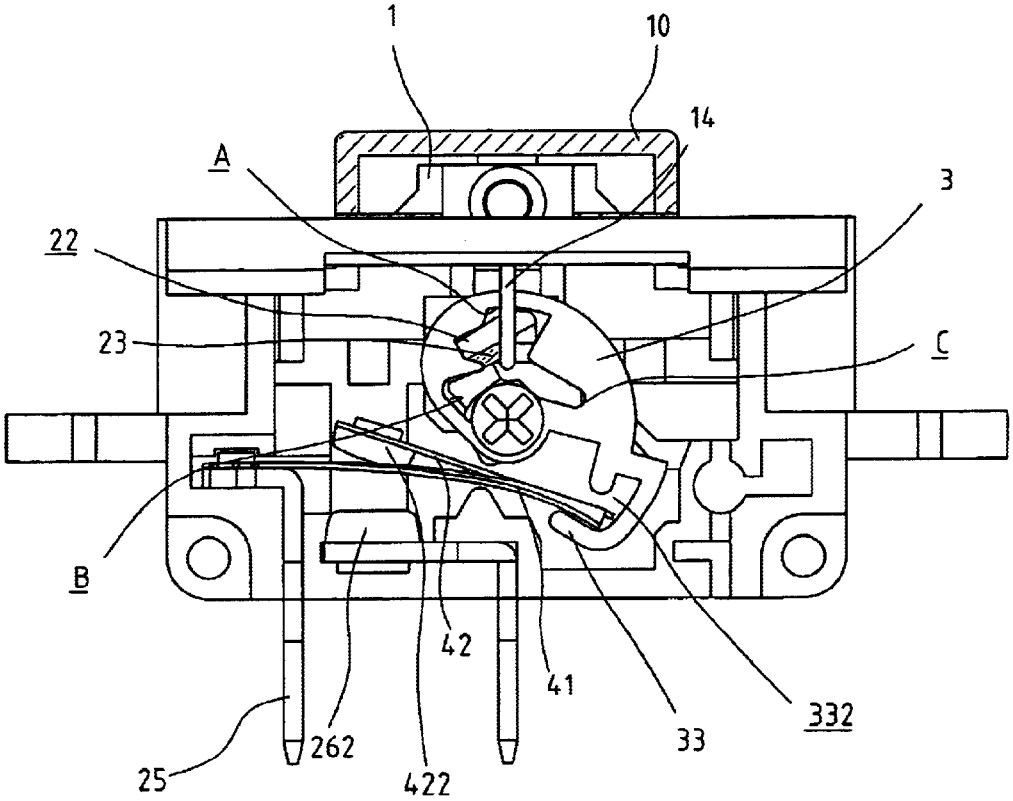
FIG. 10 shows that a bimetallic plate is deformed when an overloading of current occurs and the switch device is set to be OFF status.

As shown in FIG. 9, when pushing the push member 1 again, the boss 331 in the hook portion 33 is lowered to push the free end of the bimetallic plate 4 so that the two contact points 422, 262 are separated so as to form the OFF status. When releasing the push member 1, a gap defined between the third recess C in the aperture 31 and the protrusion 23 surrounded by the path 22 is wide enough to allow the insertion 142 to pass so that the insertion 142 is moved to the position as shown in FIG. 6. When the current is overload in the ON status as shown in FIG. 8, the bimetallic plate 4 is deformed on the opposite direction as shown in FIG. 10, and the two contact points 422, 262 are separated from each other. The deformation of the bimetallic plate 4 drives the hook portion 33 of the driving plate 3 to rotate clockwise so that the inside of the third recess C is shifted away from the insertion 142 which is lifted and passes through the gap between the third recess C in the aperture 31 and the protrusion 23 surrounded by the path 22.

Figure 11:
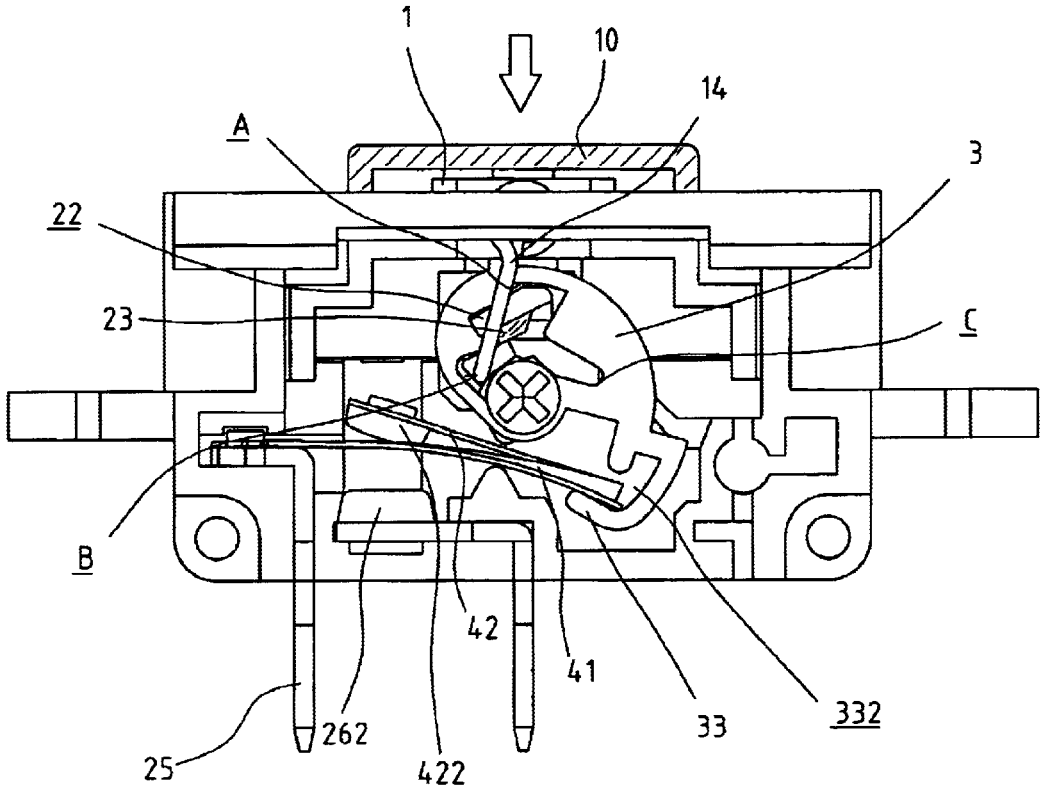
FIG. 11 shows that when the switch device is overloaded, the push member is pushed and the driving plate rotated without being interrupted by the guide pin.

As shown in FIG. 11, when the switch device is in overload status and the push member 1 is pushed again, the insertion 142 rotates the driving plate 3 and forces the two contact points 422, 162 in contact with each other. Because the current is overload, the bimetallic plate 4 deforms again to separate the two contact points 422, 162. This separation of the two contact points 422, 162 makes the driving plate 3 rotate again and the insertion 142 is moved into the second recess B while the driving plate 3 is rotated. Therefore, the rotation of the driving plate 2 is not interrupted by the insertion 142. The number of the parts of the switch device is less than that used in the conventional switch devices.

While we have shown and described the embodiment in accordance with the present invention, it should be clear to those skilled in the art that further embodiments may be made without departing from the scope of the present invention.

What is claimed is:

1. A switch device comprising:

a casing having a path defined therein and a protrusion surrounded by the path, a first terminal and a second terminal each having an end located in the casing and the other end extending from a bottom of the casing, the terminals having a first contact point on the end thereof in the casing;

a push member movably engaged on a top of the casing and two positioning springs biased between the push member and the casing, a guide pin pivotably connected to the push member and having an insertion which is movably engaged with the path in the casing;

a bimetallic plate having an end connected to the first terminal and including a free section, a second contact point connected to the free section and located above the first contact point, and a driving plate rotatably connected to the casing and including a polygonal aperture through which the insertion of the guide pin and the protrusion extend, the polygonal aperture including a first recess, a second recess and a third recess, the switch device is in OFF status when the insertion of the guide pin engaged with the first recess, the switch device is in ON status when the insertion of the guide pin engaged with the second recess, the second recess allowing the insertion of the guide pin not to impede rotation of the driving plate in overload, a hook portion extending from the driving plate and holding a free end of the bimetallic plate.

2. The switch device as claimed in claim 1, wherein the push member having a bar and the guide pin has a ring that is mounted to the bar.

3. The switch device as claimed in claim 2, wherein a spring is mounted to the bar and pressed on the ring to apply a force to the insertion toward the path.

4. The switch device as claimed in claim 1, wherein a boss extends from an inner periphery of the hook portion and the free end of the bimetallic plate extends through a gap between the boss and the inner periphery of the hook portion.

5. The switch device as claimed in claim 1, wherein the casing includes two recesses defined in an inside thereof so as to receive the two positioning springs therein.

6. The switch device as claimed in claim 1, wherein the casing includes two engaging notches defined in an inside thereof and a transverse bar is connected between two opposite walls of the casing, the transverse bar having two engaging notches, the push member including four ridges which are engaged with the engaging notches of the casing.

7. The switch device as claimed in claim 1, wherein a gap is defined between the third recess in the aperture and the protrusion surrounded by the path, the gap being wide enough to allow the insertion to pass.

* * * * *